US006139424A

United States Patent [19]

Schultz

[11] Patent Number: 6,139,424

[45] Date of Patent: Oct. 31, 2000

[54] ENVIRONMENTALLY CONTROLLED CROP STORAGE BUILDING

[75] Inventor: Duane B. Schultz, Sauk Rapids, Minn.

[73] Assignee: Winkelman Building Corp., Sauk Rapids, Minn.

[21] Appl. No.: 09/086,319

[22] Filed: May 28, 1998

[51] Int. Cl.[7] ..... E04H 7/18

[52] U.S. Cl. ..... 454/180; 454/182

[58] Field of Search ..... 454/174, 175, 454/179, 180, 181, 182

[56] References Cited

U.S. PATENT DOCUMENTS

| | | | |
|---|---|---|---|
| 1,256,677 | 2/1918 | French | 454/180 |
| 1,256,681 | 2/1918 | French . | |
| 1,365,571 | 1/1921 | Vaughan . | |
| 1,488,264 | 3/1924 | Martin . | |
| 1,629,392 | 5/1927 | Killion . | |
| 2,196,391 | 4/1940 | Gronert . | |
| 2,641,988 | 6/1953 | Perkins | 454/180 X |
| 2,652,764 | 9/1953 | Kahlstorf | 454/175 |
| 2,656,783 | 10/1953 | Heal . | |
| 2,901,960 | 9/1959 | Barre . | |
| 3,196,774 | 7/1965 | Kripal . | |
| 3,280,473 | 10/1966 | Sullivan . | |
| 3,921,508 | 11/1975 | Merson . | |
| 4,073,110 | 2/1978 | Kennedy . | |
| 4,282,694 | 8/1981 | Mead . | |

FOREIGN PATENT DOCUMENTS

| | | | |
|---|---|---|---|
| 1035027 | 8/1953 | France | 454/180 |
| 1386208 | 12/1964 | France | 454/175 |
| 826149 | 4/1981 | U.S.S.R. | 454/180 |

*Primary Examiner*—Harold Joyce
*Attorney, Agent, or Firm*—Gerald E. Helget; Rider, Bennett, Egan & Arundel, LLP; Nelson R. Capes

[57] ABSTRACT

An environmentally-controlled crop storage building consisting of: a floor having a length and a width, the floor resting on compacted soil; an air-carrying plenum extending the length of the floor within the compacted soil, the plenum having a bottom, plenum side walls, and an open plenum top communicating with the building's interior; a fan adapted to force air through the plenum; a plurality of air-carrying flumes extending the width of the floor within the compacted soil and intersecting the plenum; a plurality of flume covers having a number of apertures adapted to allow air forced through the flumes by the fan to enter the building; and a plurality of plenum covers adapted to close off the plenum from the building's interior.

19 Claims, 2 Drawing Sheets

ENVIRONMENTALLY CONTROLLED CROP STORAGE BUILDING

BACKGROUND OF THE INVENTION

This invention relates to environmentally-controlled crop storage building for storing crops such as potatoes.

It is well known that in order to store potatoes and similar crops in a building, it is necessary to provide a constant air circulation to maintain a constant temperature and humidity.

The necessary air circulation has, in the past, been provided by a fan which forces air into the building, where the air is further distributed among the crop.

However, such earlier buildings have circulated the air throughout the building by providing a raised or false floor above the building's actual floor, with ducts within the raised or false floor for carrying the forced air.

Such raised floor air distribution systems have a major defect that the floor cannot receive enough support that a vehicle, such as a front-end loader, can be driven on the false floor in order to move the crop around.

In other systems, the air ducts actually lie on top of the building's floor, making it impossible to drive a vehicle within the building.

There is, therefore, a need for an environmentally-controlled crop storage building with an air-distribution system that lies entirely beneath the building's floor, that is, within the compacted soil supporting the building's floor. This structure does not decrease the natural structural strength of the floor, so that a vehicle may readily be driven over the floor.

SUMMARY OF THE INVENTION

An environmentally-controlled crop storage building consisting of: a floor having a length and a width, the floor resting on compacted soil; an air-carrying plenum extending the length of the floor within the compacted soil, the plenum having a bottom, plenum side walls, and an open plenum top communicating with the building's interior; a fan adapted to force air through the plenum; a plurality of air-carrying flumes extending the width of the floor within the compacted soil and intersecting the plenum; a plurality of flume covers having a number of apertures adapted to allow air forced through the flumes by the fan to enter the building; and a plurality of plenum covers adapted to close off the plenum from the building's interior.

DETAILED DESCRIPTION OF THE PREFERRED EMBODIMENTS

Figure 1:
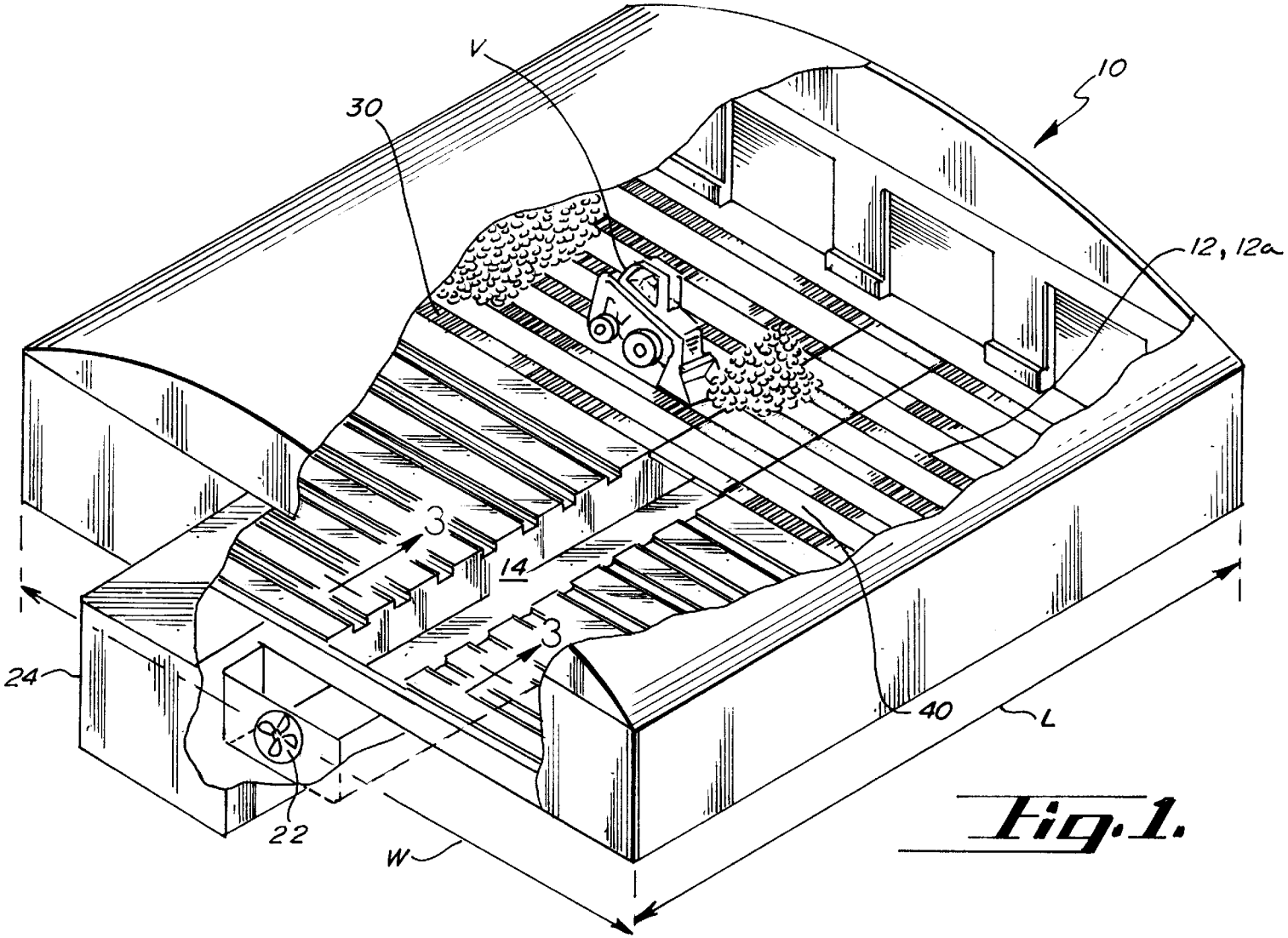
FIG. 1 is a perspective view of the environmentally-controlled storage building of the present invention with some structure cut away to show internal structure.
Figure 2:
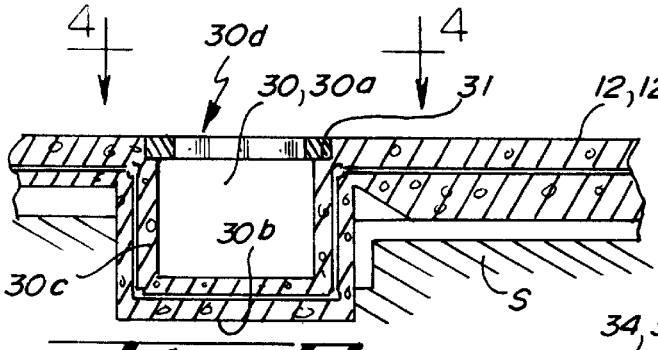
FIG. 2 is a cross-section along the lines 2 of FIG. 3.
Figure 4:
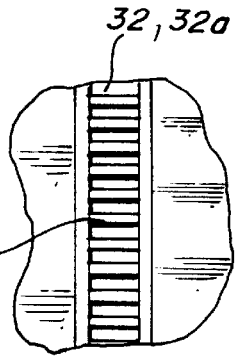
FIG. 4 is a top plan view along the lines 4 of FIG. 2.
Figure 3:
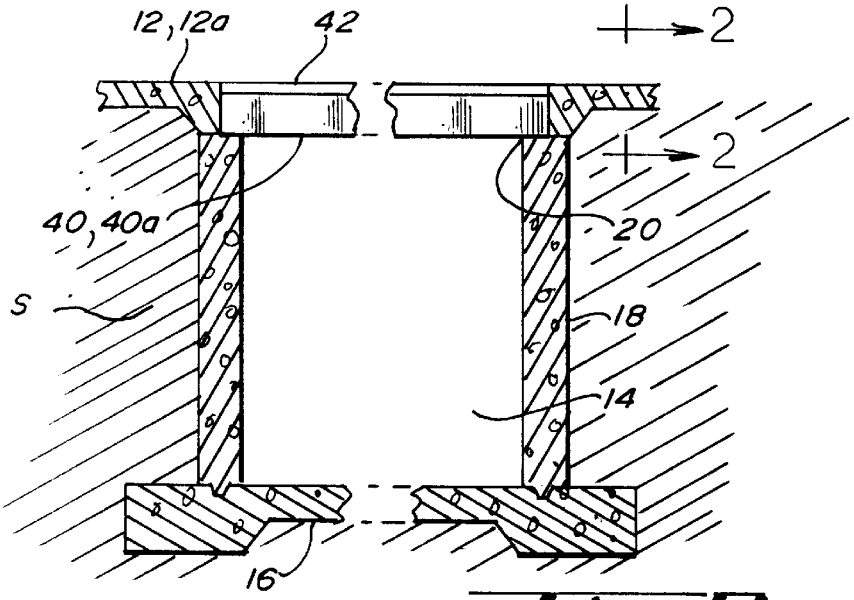
FIG. 3 is a cross-section along the lines 3 of FIG. 1.
Figure 5:
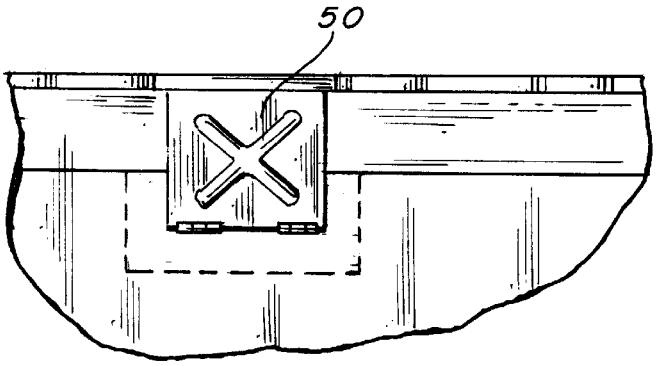
FIG. 5 is a side elevational view of one of the trenches showing a door covering the trench entrance.

The environmentally-controlled crop storage building of the present invention is shown generally in the Figures as reference numeral 10.

The building 10 comprises a floor 12 having a length L and a width W. The floor 12 rests on compacted soil S.

An air-carrying plenum 14 extends the length L of the floor 10 within the compacted soil S. The plenum 14 has a bottom 16, plenum side walls 18, and an open plenum top 20 communicating with the building's interior.

A fan 22 is adapted to force air through the plenum 14. Preferably, the fan is mounted in a fan house 24 external to the building 10.

A plurality of air-carrying flumes 30 extend the width W of the floor 12 within the compacted soil S and intersect the plenum 14.

The flumes 30 are covered by a plurality of flume covers 32 which have a number of apertures 34 adapted to allow air forced through the flumes 30 by the fan 22 to enter the building.

The plenum 14 is covered by a plurality of plenum covers 40 adapted to close off the plenum 14 from the building's interior.

In the preferred embodiment, the floor 12 is a concrete slab 12*a*. By way of example, the concrete slab 12*a* may be about 5 inches thick.

In the preferred embodiment, the floor 12 rests on the plenum sidewalls 18, which are reinforced.

In the preferred embodiment, the flumes 30 are precast trenches 30*a*. The trenches 30*a* have a base 30*b*, trench side walls 30*c* and an open trench top 30*d* communicating with the building's interior. Preferably, there is a support groove 31 in the trench side walls 30*c* near the open trench top 30*d*. The flume covers 32 rest in the support groove 31 to thereby allow a vehicle to be driven over the trenches.

In the preferred embodiment, the flume covers 32 further comprise one and three-quarter inch planks 32*a*. The planks 32*a* may be made of any structurally strong material, and are preferably made of wood. The apertures 34 may be of any shape, but are preferably slits 34*a* transverse to the length of the covers 32. When the planks 32*a* are placed into the support groove 31, the tops of the planks 32*a* will be level with the floor 12.

In the preferred embodiment, the plenum covers 40 further comprise precast concrete planking 40*a* spanning the plenum 14 and resting on the plenum sidewalls 18. Most preferably, the planking 40*a* has a thickness of about 12 inches. Applicant has found that this thickness provides sufficient support for vehicles for the required span length. Optimally, the concrete planking 40*a* is covered with one and three-quarter inch planks 42. The planks 42 may be of any structurally strong material, and are preferably made of wood. When the concrete planking 40*a* and planks 42 are placed across the plenum 14, the top of the planks 42 will be level with the top of the floor 12.

In the preferred embodiment, the trenches 30*a* have a hinged door 50 adapted to close off the trenches 30*a* from the plenum 14, thereby selecting which trenches will receive air from the fan 22.

The building 10 is constructed as follows. First, the plenum 14 is excavated out of the compacted soil S. Then the floor 16 and walls 18 of the plenum 14 are poured. Next, the trenches 30*a* are excavated out of the compacted soil S and the precast trenches 30*a* are inserted into these excavations. The concrete floor 12*a* is then poured between the trenches 30*a*. The optional hinged doors 50 are mounted to the trenches 30*a* where the trenches 30*a* intersect the plenum 14.

To circulate air to the crop, the fan 22 is turned on and selected ones of the optional hinged doors 50 are opened. Air then flows through the plenum 14, the trenches 30*a*, and the apertures 34 to reach the crop.

Because the plenum 14 and trenches 30*a* are below the level of the floor 12 and rest on compacted soil S, the plenum 14 and trenches 30*a* do not get in the way of a vehicle V which may be driven over the floor 12 and are structurally strong enough to support the vehicle V.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An environmentally-controlled crop storage building comprising:

(a) a floor having a length and a width, the floor resting on compacted soil;

(b) an air-carrying plenum extending the length of the floor at a level within the compacted soil, the plenum having a bottom, plenum side walls, and an open plenum top communicating with the building's interior;

(c) a fan mounted at the level of the plenum adapted to force air through the plenum;

(d) a plurality of air-carrying flumes extending the width of the floor within the compacted soil and intersecting the plenum wherein the flumes further comprise precast trenches, the trenches having a base, trench side walls and an open trench top communicating with the building's interior;

(e) a plurality of flume covers having a number of apertures adapted to allow air forced through the flumes by the fan to enter the building; and (f) a plurality of plenum covers adapted to close off the plenum from the building's interior.

2. The crop storage building of claim 1, wherein the floor further comprises a concrete slab.

3. The crop storage building of claim 1, wherein the floor rests on the plenum side walls.

4. The crop storage building of claim 1, further comprising a support groove in the trench side walls near the open trench top, the flume covers resting in the support groove to thereby allow a vehicle to be driven over the trenches.

5. The crop storage building of claim 4, wherein the flume covers further comprise one and three-quarter inch planks.

6. The crop storage building of claim 3, wherein the plenum covers further comprise precast concrete planking spanning the plenum and resting on the plenum sidewalls.

7. The crop storage building of claim 6, wherein the precast concrete planking has a thickness of about 12 inches.

8. The crop storage building of claim 6, wherein the plenum covers further comprise one and three-quarter inch planks resting on the precast concrete planking.

9. The crop storage building of claim 1, further comprising hinged doors adapted to close off the trenches from the plenum, thereby selecting which trenches will receive air from the fan.

10. An environmentally-controlled crop storage building comprising:

(a) a floor having a length and a width, the floor resting on compacted soil and the floor further comprising a concrete slab;

(b) an air-carrying plenum extending the length of the floor at a level within the compacted soil, the plenum having a bottom, plenum side walls, and an open plenum top communicating with the building's interior, the floor resting on the plenum side walls;

(c) a fan mounted at the level of the plenum adapted to force air through the plenum;

(d) a plurality of air-carrying flumes extending the width of the floor within the compacted soil and intersecting the plenum wherein the flumes further comprise precast trenches, the trenches having a base, trench side walls and an open trench top communicating with the building's interior;

(e) a plurality of flume covers having a number of apertures adapted to allow air forced through the flumes by the fan to enter the building; and (f) a plurality of plenum covers adapted to close off the plenum from the building's interior.

11. The crop storage building of claim 10, further comprising a support the trench side walls near the open trench top, the flume covers resting in the support to thereby allow a vehicle to be driven over the trenches.

12. The crop storage building of claim 10, wherein the flume covers comprise one and three-quarter inch planks.

13. The crop storage building of claim 10, wherein the plenum covers comprise precast concrete planking spanning the plenum and resting on the plenum.

14. The crop storage building of claim 13, wherein the precast concrete planking has a thickness of about 12 inches.

15. The crop storage building of claim 13, wherein the plenum covers further comprise one and three-quarter inch planks resting on the precast concrete planking.

16. The crop storage building of claim 10, further comprising hinged doors adapted to close off the trenches from the plenum, thereby selecting which trenches will receive air from the fan.

17. An environmentally-controlled crop storage building comprising:

(a) a floor having a length and a width, the floor resting on compacted soil and the floor further comprising a concrete slab;

(b) an air-carrying plenum extending the length of the floor within the compacted soil, the plenum having a bottom, plenum side walls, and an open plenum top communicating with the building's interior, the floor resting on the plenum side walls;

(c) a fan mounted in a fan house external to the building and the fan being adapted to force air through the plenum;

(d) a plurality of air-carrying flumes extending the width of the floor within the compacted soil and intersecting the plenum wherein the flumes further comprise precast trenches, the trenches having a base, trench side walls and an open trench top communicating with the building's interior, further comprising a support groove in the trench side walls near the open trench top;

(e) a plurality of flume covers having a number of apertures adapted to allow air forced through the flumes by the fan to enter the building, the flume covers resting in the support groove to thereby allow a vehicle to be driven over the trenches;

(f) a plurality of plenum covers adapted to close off the plenum from the building's interior, wherein the plenum covers further comprise precast concrete planking spanning the plenum and resting on the plenum sidewalls and being of sufficient thickness to allow a vehicle to be driven over the plenum; and (g) hinged doors adapted to close off the trenches from the plenum, thereby selecting which trenches will receive air from the fan.

18. The crop storage building of claim 17, wherein the precast concrete planking has a thickness of about 12 inches.

19. The crop storage building of claim 17, wherein the plenum covers further comprise one and three-quarter inch planks resting on the precast concrete planking.

* * * * *